US006344001B1

(12) United States Patent
Hamada et al.

(10) Patent No.: US 6,344,001 B1
(45) **Date of Patent: *Feb. 5, 2002**

(54) IRON GOLF CLUB HEADS, IRON GOLF CLUBS AND GOLF CLUB EVALUATING METHOD

(75) Inventors: Jiro Hamada, 2704, Yamazaki, Noda-shi, Chiba-ken; Takaoki Ito, Tokyo, both of (JP)

(73) Assignee: Jiro Hamada (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,514

(22) Filed: Jul. 14, 2000

Related U.S. Application Data

(60) Continuation of application No. 09/538,151, filed on Mar. 29, 2000, which is a division of application No. 09/105,961, filed on Jun. 29, 1998, now Pat. No. 6,086,485.

(30) Foreign Application Priority Data

Dec. 18, 1997 (JP) ..... 9-349381

(51) Int. Cl.[7] ..... A63B 53/04

(52) U.S. Cl. ..... 473/329; 473/332; 473/338; 473/350; 473/349

(58) Field of Search ..... 473/324, 329, 473/330, 334, 335, 336, 337, 338, 332, 345, 346, 347, 348, 349, 350, 290, 291, 292, 293; D21/747–752

(56) References Cited

U.S. PATENT DOCUMENTS

| | | | |
|---|---|---|---|
| 632,885 | A | 9/1899 | Sweny |
| 2,429,351 | A | 10/1947 | Fetterolf |
| 3,079,157 | A | 2/1963 | Turner |
| 3,556,532 | A | 1/1971 | Ballmer |
| 4,322,083 | A | 3/1982 | Imai |
| 4,398,965 | A | 8/1983 | Campau |
| 4,523,759 | A | 6/1985 | Igarashi |
| 4,836,550 | A | 6/1989 | Kobayashi |
| 5,056,788 | A | 10/1991 | Katayama |
| 5,330,187 | A | 7/1994 | Schmidt et al. |
| 5,492,327 | A | 2/1996 | Biafore, Jr. |
| 5,564,705 | A | 10/1996 | Kobayashi et al. |
| 6,086,485 | A | 7/2000 | Hamada |

FOREIGN PATENT DOCUMENTS

| | | |
|---|---|---|
| GB | 2 126 486 | 3/1984 |
| TW | 298080 | 6/1985 |
| TW | 79206332 | 1/1988 |

OTHER PUBLICATIONS

Co–pending Continuation Application No. 09/538,151, Attorney Docket No. 6896.0005–01, Title: Iron Golf Club Heads, Iron Golf Clubs and Golf Club Evaluating Method, Inventors: Jiro Hamada et al., U.S. Filing Date: Mar. 29, 2000.

(List continued on next page.)

*Primary Examiner*—Sebastiano Passaniti
(74) *Attorney, Agent, or Firm*—Finnegan, Henderson, Farabow, Garrett & Dunner, L.L.P.

(57) ABSTRACT

A variety of novel clubheads and iron golf clubs with the novel heads are provided by reexamining the conventional views that iron golf clubs with a low center of gravity have good performance, and introducing a new criterion for evaluation to obtain iron golf clubs capable of sending the ball better distance. A clubhead includes a face forming portion having a face formed on the forward surface thereof, and a sole forming portion extending rearwardly from the lower end of the face forming portion. The sole forming portion has a sole formed on the bottom thereof. The sole forming portion is provided with one of a hole, a hollow portion and a filling portion near the face forming portion.

22 Claims, 15 Drawing Sheets

OTHER PUBLICATIONS

Co–pending Continuation Application No. 09/551,654, Attorney Docket No. 6896.0005–02, Title: Iron Golf Club Heads, Iron Golf Clubs and Golf Club Evaluating Method, Inventor: Jiro Hamada et al., U.S. Filing Date: Apr. 18, 2000.

Co–pending Continuation Application No. 09/551,655, Attorney Docket No. 6896.0005–03, Title: Iron Golf Club Heads, Iron Golf Clubs and Golf Club Evaluating Method, Inventor: Jiro Hamada et al., U.S. Filing Date: Apr. 18, 2000.

English Language Translation of Taiwanese Patent Publication No. 298080.

Golf catalog excerpt showing an advertisement for "Wilson Reflex" golf clubs (Japanese), dated Feb. 26, 1980.

No.1 TI 100
#5
26°

No.2 PALMER TITAN IRON
#5
26.5°

No.3 845s
#5
28°

No.4 GULLIVER
#5
28°

No.5 GULLIVER 272RX
#5
26°

No.6 GALILEO 282
#5
26°

IRON GOLF CLUB HEADS, IRON GOLF CLUBS AND GOLF CLUB EVALUATING METHOD

This is a continuation of Ser. No. 09/538,151, filed Mar. 29, 2000 (pending), which is a division of application Ser. No. 09/105,961, filed on Jun. 29, 1998 now U.S. Pat. No. 6,086,485, the entire disclosures of which are incorporated herein by reference.

BACKGROUND OF THE INVENTION

The present invention relates to iron golf clubs.

Recently, attention has been focused on iron golf clubs with heads made of titanium. Titanium has a small specific gravity and high strength. Therefore, iron golf clubs with titanium heads enable the head size to increase and hence make it possible to enlarge the sweet spot.

In the field of golf clubs with titanium heads, particularly iron clubs, there have been developed clubs in which a metal having a large specific gravity is buried in the sole to lower the center of gravity of the clubhead. However, it is technically difficult to bury a different kind of metal in the sole, and this leads to a rise in the production cost and causes the rejection rate to increase.

Conventional iron golf clubs have been designed so that the ball contacts the sweet spot on the clubface at impact. However, the research conducted by the present inventor has revealed that the farthest distance is attained when the ball contacts the sweet spot at right angles to the clubface, and that the point where the farthest distance is obtained is not the sweet spot when the clubface meets the ball at a predetermined angle of tilt as is the case with iron golf clubs.

SUMMARY OF THE INVENTION

In view of the above-described background, an object of the present invention is to provide a variety of novel clubheads and iron golf clubs with the novel heads by reexamining the conventional views that iron golf clubs with a low center of gravity have good performance, and introducing a new criterion for evaluation to obtain iron golf clubs capable of sending the ball better distance.

Another object of the present invention is to find the true point on the face of an iron golf club that sends the ball farther than any other part of the face and to provide novel clubheads having such a point and also iron golf clubs with the novel heads.

To attain the above-described objects, the present invention provides a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a hole near the face forming portion.

According to another aspect of the present invention, there is provided a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a hole closer to the face than the center of gravity of the head.

According to another aspect of the present invention, there is provided a head of an iron golf club wherein a hole is formed in a lower portion of the head near the clubface.

The hole may be elongated in the widthwise direction of the head.

The hole may extend through the sole forming portion.

According to another aspect of the present invention, there is provided a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a portion having a smaller specific gravity than that of the rest of the sole forming portion near the face forming portion.

According to another aspect of the present invention, there is provided a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a portion having a smaller specific gravity than that of the rest of the sole forming portion at a position closer to the face than the center of gravity of the head.

According to another aspect of the present invention. there is provided a head of an iron golf club wherein a lower portion of the head near the clubface is provided with a portion having a smaller specific gravity than that of the rest of the head.

The portion having a smaller specific gravity may be elongated in the widthwise direction of the head.

According to another aspect of the present invention, there is provided a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a hollow portion near the face forming portion.

According to another aspect of the present invention, there is provided a head of an iron golf club which includes a face forming portion having a face formed on the forward surface thereof, and a sole forming portion extending rearwardly from the lower end of the face forming portion. The sole forming portion has a sole formed on the bottom thereof. The sole forming portion is provided with a hollow portion at a position closer to the face than the center of gravity of the head.

According to another aspect of the present invention, there is provided a head of an iron golf club wherein a hollow portion is formed in a lower portion of the head near the clubface.

The hollow portion may be elongated in the widthwise direction of the head.

According to another aspect of the present invention, there is provided a head of a No. 2 iron golf club wherein in a state where the head has been correctly positioned with respect to a golf ball upon addressing, the angle $\theta$ of intersection between a horizontal line containing a meeting point on the clubface and a line connecting the meeting point and the center of gravity of the head is in the range of from 0° to 19.2°.

According to another aspect of the present invention, there is provided a head of a No. 3 iron golf club wherein in a state where the head has been correctly positioned with respect to a golf ball upon addressing, the angle $\theta$ of intersection between a horizontal line containing a meeting point on the clubface and a line connecting the meeting point and the center of gravity of the head is in the range of from 0° to 23.2°.

According to another aspect of the present invention, there is provided a head of a No. 4 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 26.0°.

According to another aspect of the present invention, there is provided a head of a No. 5 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 27.3°.

According to another aspect of the present invention, there is provided a head of a No. 6 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 29.3°.

According to another aspect of the present invention, there is provided a head of a No. 7 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 30.3°.

According to another aspect of the present invention, there is provided a head of a No. 8 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 31.0°.

According to another aspect of the present invention, there is provided a head of a No. 9 iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 31.6°.

According to another aspect of the present invention, there is provided a head of a pitching wedge iron golf club wherein in a state where the head has been correctly positioned with respect to a golf ball upon addressing, the angle θ of intersection between a horizontal line containing a meeting point on the clubface and a line connecting the meeting point and the center of gravity of the head is in the range of from 0° to 30.8°.

The heads of the No. 2 to 9 and pitching wedge iron golf clubs may be arranged such that in a state where each head has been correctly positioned with respect to a golf ball upon addressing, the centers of gravity of the iron golf clubs lie at approximately equal heights from the ground.

In addition, the present invention provides an iron golf club evaluating method wherein the performance of an iron golf club is evaluated by judging whether or not, in a state where the head of the iron golf club has been correctly positioned with respect to a golf ball upon addressing, the angle θ of intersection between a horizontal line containing a meeting point on the clubface and a line connecting the meeting point and the center of gravity of the head falls within a predetermined angle range.

According to another aspect of the present invention, there is provided a head of an iron golf club wherein a meeting point on the clubface is below a sweet spot on the clubface.

In this case, the release point may be coincident with the sweet spot.

In addition, the present invention provides an iron golf club having any of the foregoing heads.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements.

DESCRIPTION OF THE PREFERRED EMBODIMENTS

Figure 1:
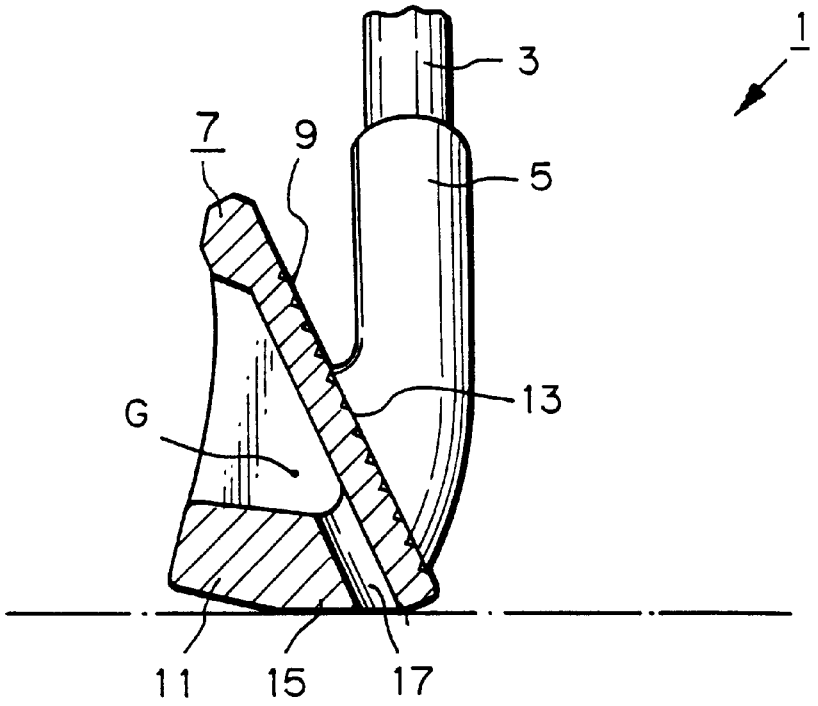
FIG. 1 is a sectional view showing an embodiment of the head of an iron golf club according to the present invention.

Embodiments of the present invention will be described below with reference to the accompanying drawings. FIG. 1 shows a lower portion of an iron golf club 1 having a head according to the present invention. In the figure, reference numerals 3, 5 and 7 denote a shaft, a hosel and a head, respectively. It should be noted that in the description of the present invention, a direction in which the head travels to hit the ball is defined as a forward direction, and a direction opposite to it as a rearward direction. Further, the hosel side of the iron golf club relative to the head (i.e. the side closer to the player upon addressing) is defined as a near side, and a direction opposite to it as a far side.

The head 7 has a face forming portion 9 and a sole forming portion 11. A face 13 is formed on a forward surface of the face forming portion 9, and a sole 15 is formed on the bottom of the sole forming portion 11. The head 7 is an integrally-molded cast article as a whole. Accordingly, the face forming portion 9 and the sole forming portion 11 are integral with each other. In the present invention, the terms "face forming portion 9" and "sole forming portion 11" are used for the sake of description; in this specification, a thick-walled portion having a face 13 formed on its forward side is defined as a face forming portion 9, and a thick-walled portion having a sole 15 formed on its bottom is defined as a sole forming portion 11.

Figure 2:
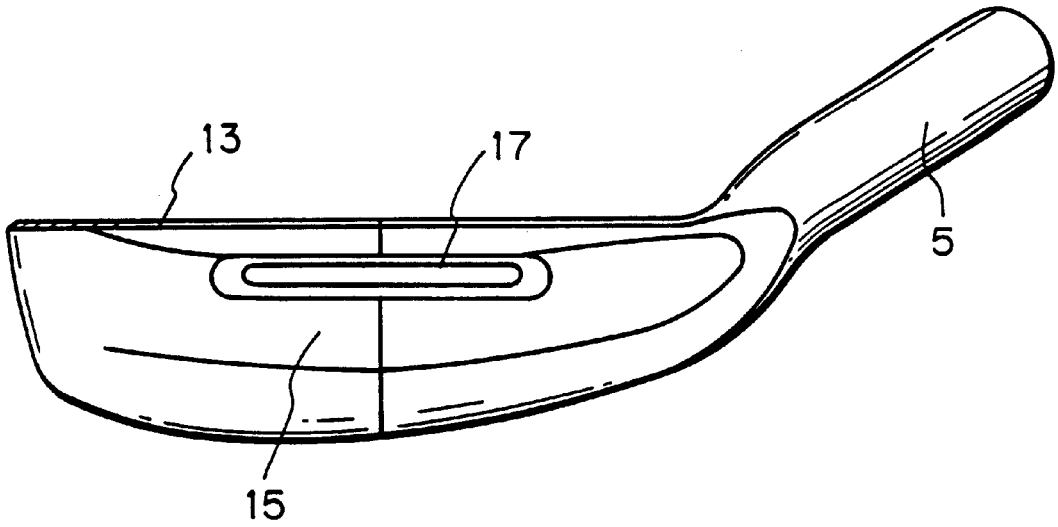
FIG. 2 is a bottom view of the head shown in FIG. 1.

As shown in FIGS. 1 and 2, the sole forming portion 11 is provided with a hole 17 near the face forming portion 9. As shown in FIG. 1, the hole 17 extends through the sole forming portion 11 approximately in parallel to the face 13. As shown in FIG. 2, the hole 17 is formed in the shape of an elongated hole extending in the widthwise direction of the head 7, i.e. from the hosel-side end of the head 7 toward the other end thereof.

The hole 17 is preferably formed in the sole forming portion 11 near the face 13. However, the hole 17 may virtually extend to the face forming portion 9. It is preferable for the hole 17 to be positioned as close to the face 13 as possible relative to the center of gravity G of the head 7.

Figure 3:
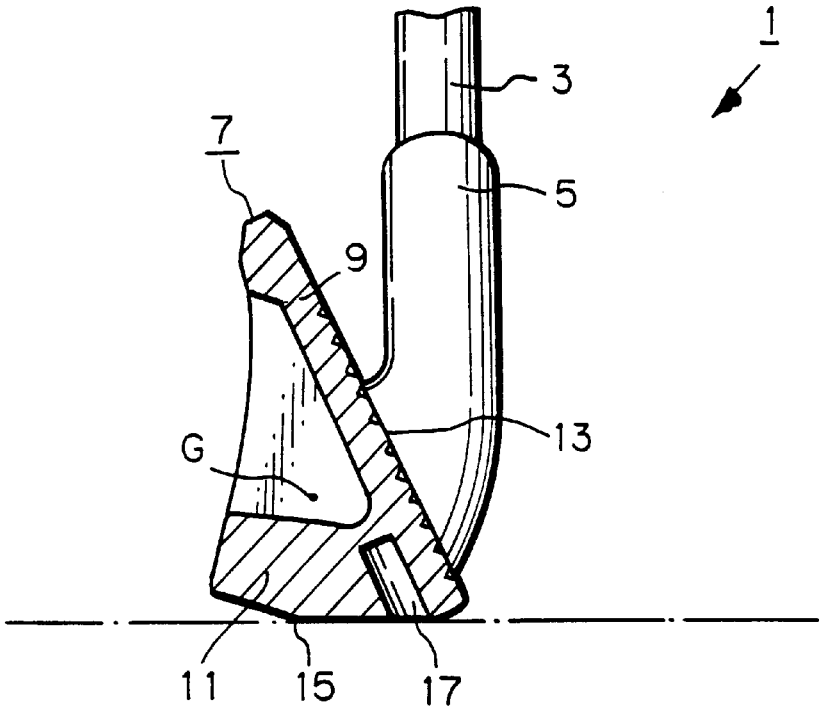
FIG. 3 is a sectional view showing another embodiment of the head of an iron golf club according to the present invention.
Figure 4:
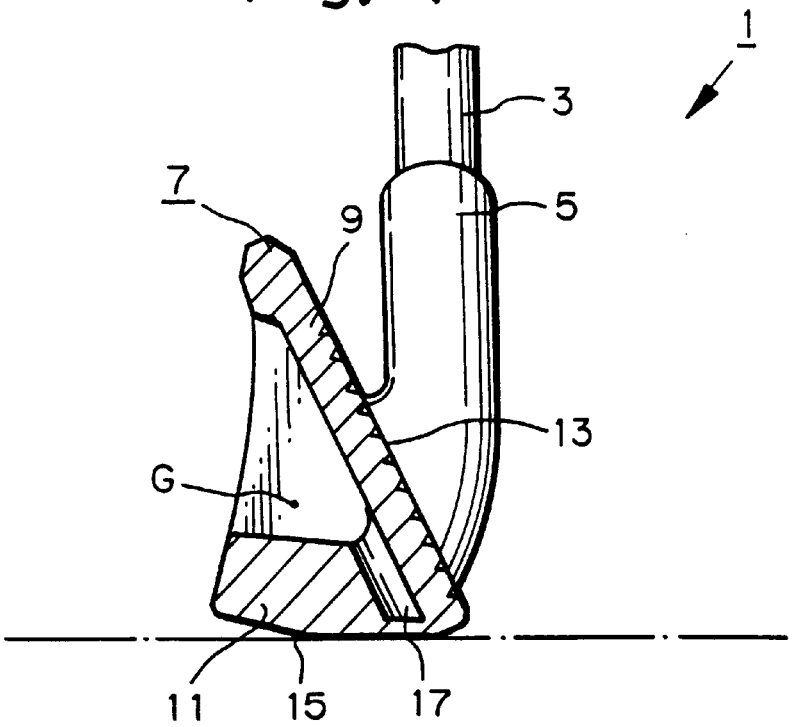
FIG. 4 is a sectional view showing another embodiment of the head of an iron golf club according to the present invention.

As shown in FIG. 3, the hole 17 may be such that only the sole-side end thereof is open, and the upper end thereof is closed. As shown in FIG. 4, the hole 17 may be formed such that only the upper end thereof is open, and the sole-side end thereof is closed.

Figure 5:
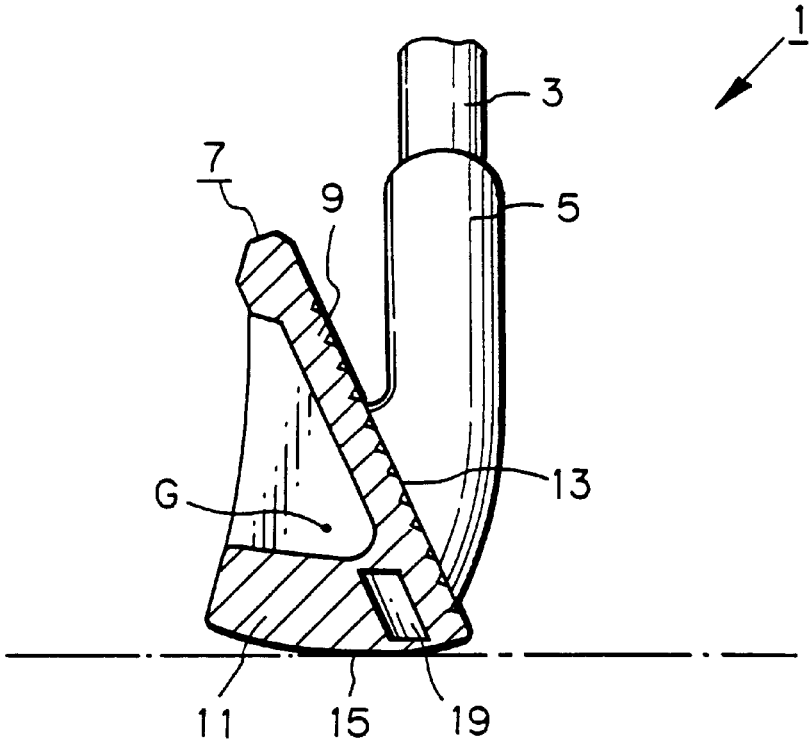
FIG. 5 is a sectional view showing another embodiment of the head of an iron golf club according to the present invention.

According to the present invention, as shown in FIG. 5, the sole forming portion 11 may be provided with a hollow portion 19 near the face forming portion 9.

Figure 6:
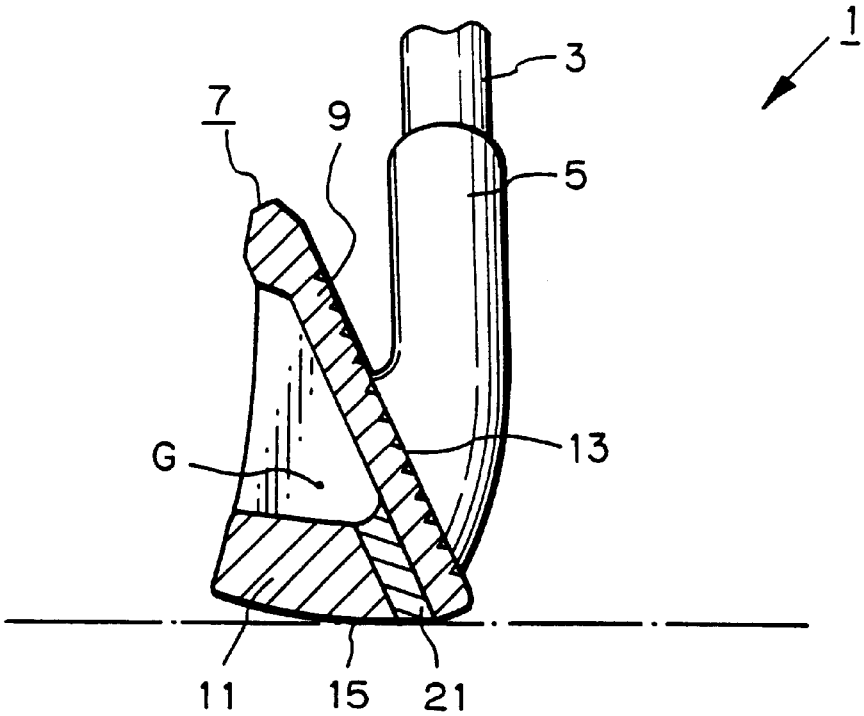
FIG. 6 is a sectional view showing another embodiment of the head of an iron golf club according to the present invention.

As shown in FIG. 6, the sole forming portion 11 may be provided with a filling portion 21 near the face forming portion 9. The filling portion 21 is filled with a metal (e.g. aluminum or titanium) whose specific gravity is smaller than that of a metal (e.g. a stainless steel or a nickel alloy) constituting the sole forming portion 11. The filling portion 21 may be filled with a substance other than a metal which has a small specific gravity, e.g. a plastic material.

The hollow portion 19 or the filling portion 21 may be elongated in the widthwise direction of the head 7. The hollow portion 19 or the filling portion 21 is preferably formed in the sole forming portion 11 near the face 13. However, the hollow portion 19 or the filling portion 21 may virtually extend to the face forming portion 9. It is preferable for the hollow portion 19 or the filling portion 21 to be provided as close to the face 13 as possible relative to the center of gravity G of the head 7.

It should be noted that the hole 17, the hollow portion 19 and the filling portion 21 may have any configuration.

According to the present invention, the sole forming portion 11 is provided with the hole 17, the hollow portion 19 or the filling portion 21 filled with a substance of small specific gravity as stated above, thereby enabling a weight to be added to the rearward end of the head 7 correspondingly to the reduction in the weight at the forward end thereof. Consequently, the center of gravity of the head 7 can be shifted toward the rearward end thereof. Accordingly, it is possible to eliminate undesirable deflections of shots and to get better distance.

In the foregoing embodiments, the present invention is applied to one form of iron golf club. The present invention may also be applied to a variety of iron golf clubs as shown in FIGS. 7 to 14.

Figure 7:
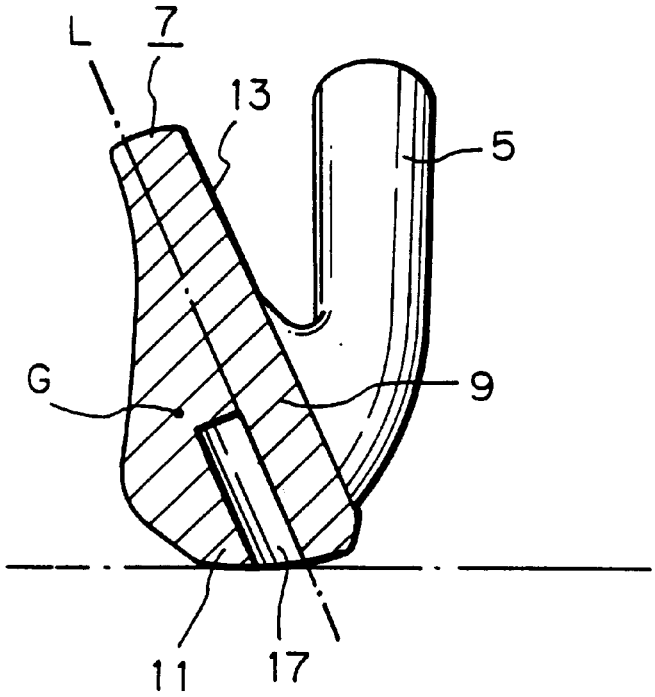
FIG. 7 is a sectional view showing an embodiment of the head of an iron golf club according to the present invention in which the head configuration is different from that of the iron golf clubs shown in FIGS. 1 to 6.
Figure 9:
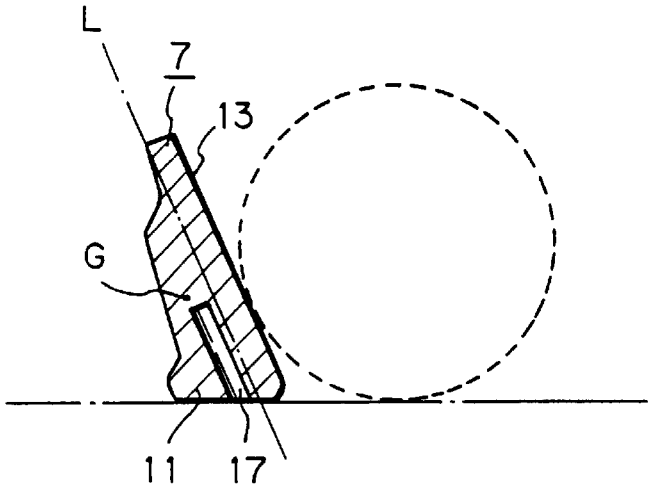
FIG. 9 is a sectional view showing an embodiment of the head of an iron golf club according to the present invention in which the head configuration is different from that of the iron golf clubs shown in FIGS. 1 to 6.
Figure 10:
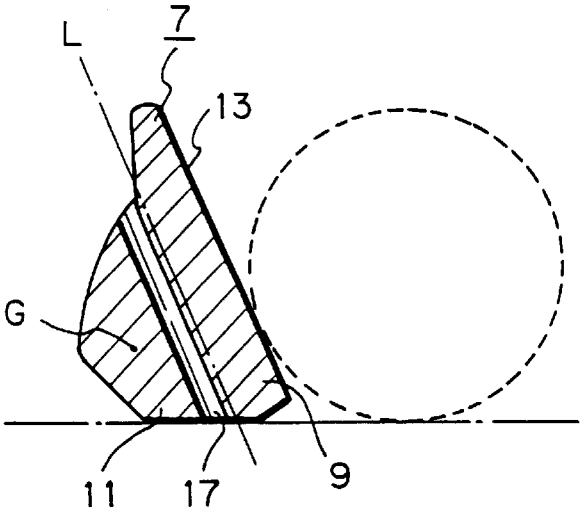
FIG. 10 is a sectional view showing an embodiment of the head of an iron golf club according to the present invention in which the head configuration is different from that of the iron golf clubs shown in FIGS. 1 to 6.

Iron golf clubs shown in FIGS. 7, 9 and 10 have heads 7 with configurations in which the face forming portion 9 and the sole forming portion 11 are difficult to distinguish from each other. In the head 7 arranged in such a form, a portion extending from the face 13 to a thickness of from 3 millimeters to 10 millimeters (i.e. a portion forward of the dashed-and-dotted line L in FIGS. 7, 9 and 10) is defined as a face forming portion 9, and a head portion lying rearward of the face forming portion 9 is defined as a sole forming portion 11. In this type of head 7 also, the hole 17 can be formed as close to the face 13 as possible.

Figure 8:
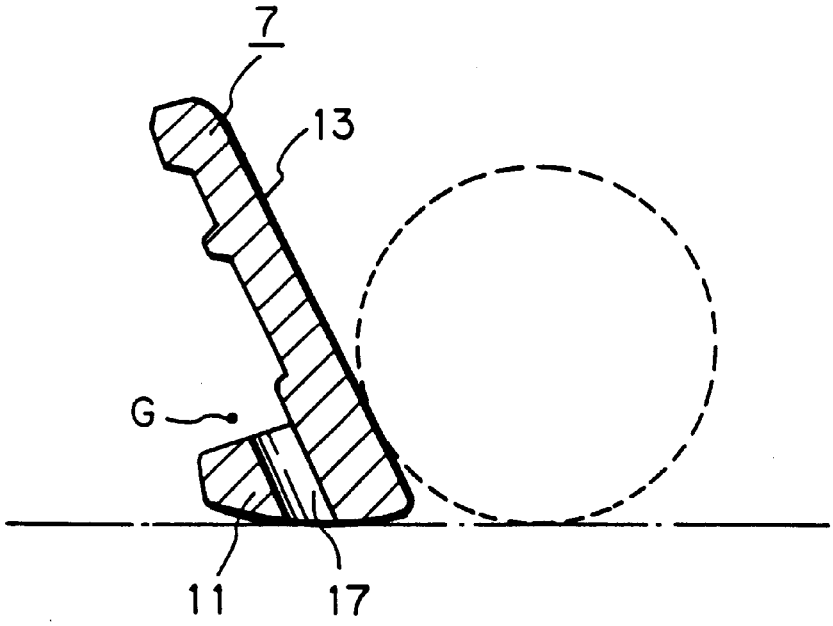
FIG. 8 is a sectional view showing an embodiment of the head of an iron golf club according to the present invention in which the head configuration is different from that of the iron golf clubs shown in FIGS. 1 to 6.
Figure 13:
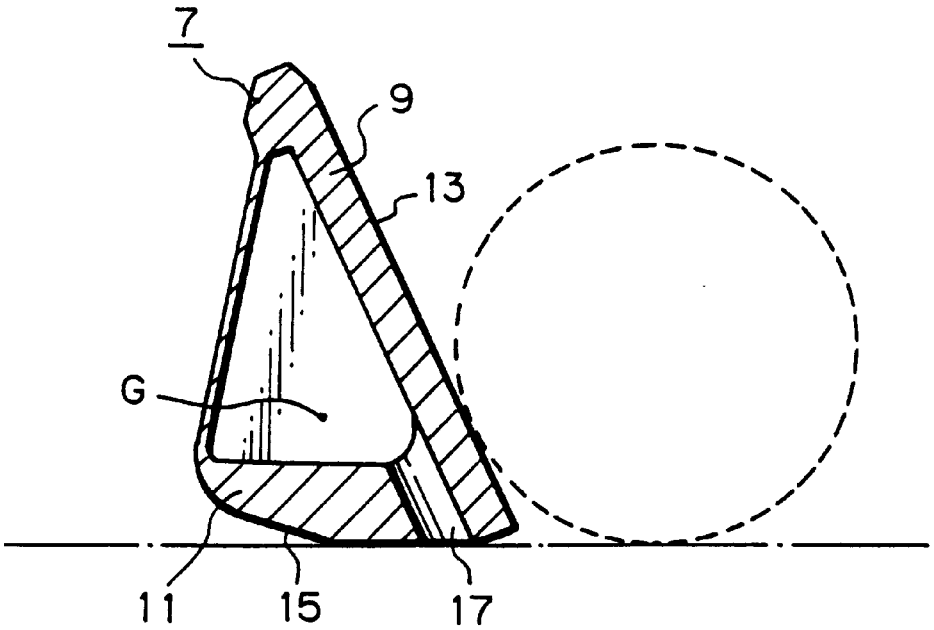
FIG. 13 is a sectional view showing an embodiment of the head of an iron golf club according to the present invention in which the head configuration is different from that of the iron golf clubs shown in FIGS. 1 to 6.

The heads 7 of iron golf clubs shown in FIGS. 8 and 13 have a shape in which the sectional configuration of the head 7 is different from that of the head 7 shown in FIG. 1. In this type of head 7 also, the hole 17 can be formed in the sole forming portion 11 near the face forming portion 9.

Figure 11:
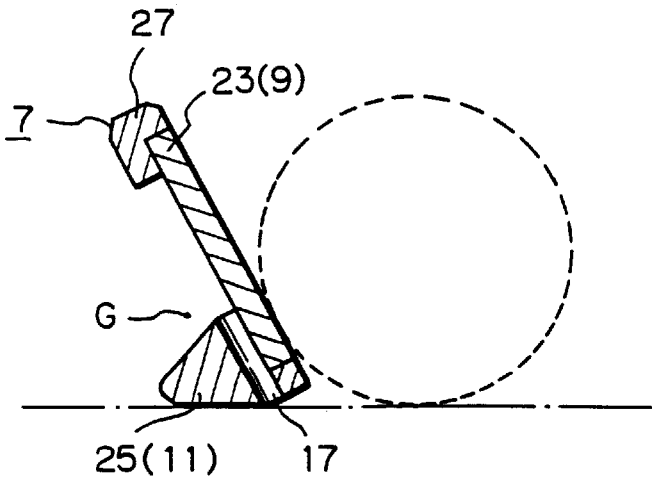
FIG. 11 is a sectional view showing an embodiment of the head of an iron golf club according to the present invention in which the head configuration is different from that of the iron golf clubs shown in FIGS. 1 to 6.
Figure 12:
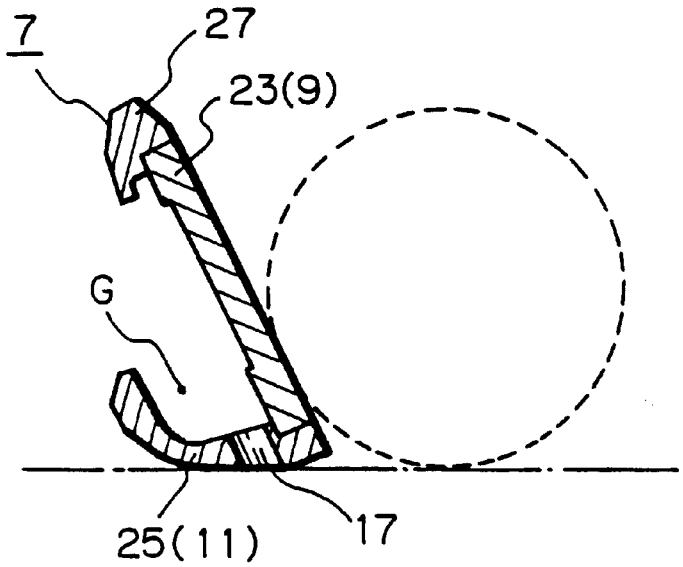
FIG. 12 is a sectional view showing an embodiment of the head of an iron golf club according to the present invention in which the head configuration is different from that of the iron golf clubs shown in FIGS. 1 to 6.

Iron golf clubs shown in FIG. 11 and 12 have heads 7 comprising a combination of a plurality of members. This type of head 7 generally comprises a face forming member 23 constituting a face forming portion 9, a sole forming member 25 constituting a sole forming portion 11, and a top member 27. In this type of head 7 also, the hole 17 can be formed in the sole forming portion 11 near the face forming portion 9.

Figure 14:
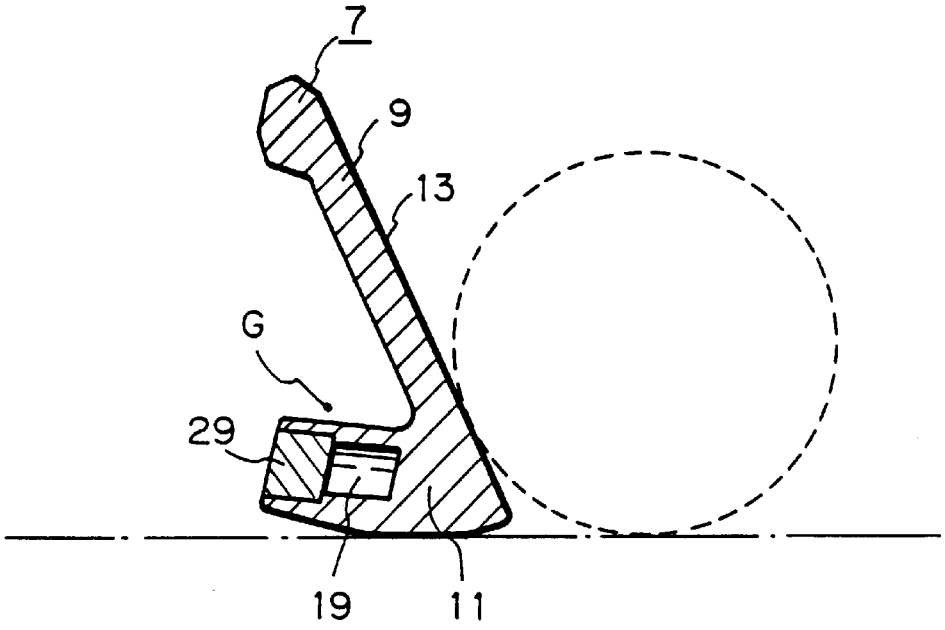
FIG. 14 is a sectional view showing an embodiment of the head of an iron golf club according to the present invention in which the head configuration is different from that of the iron golf clubs shown in FIGS. 1 to 6.

An iron golf club shown in FIG. 14 has a head 7 in which a face forming portion 9 and a sole forming portion 11 are integrally molded. The sole forming portion 11 has a hole extending forwardly from the rear end thereof. The rear end portion of the hole is blocked with a blocking member 29, thereby forming a hollow portion 19 in the sole forming portion 11.

Although the foregoing various iron golf clubs (FIGS. 7 to 14) show embodiments in which a hole 17 is formed in the head, it should be noted that a hollow portion may be provided in place of the hole 17 in the sole forming portion 11 near the face forming portion 9 of iron golf clubs having similar forms. Alternatively, a filling portion filled with a substance of small specific gravity may be provided in place of the hole 17.

Figure 15:
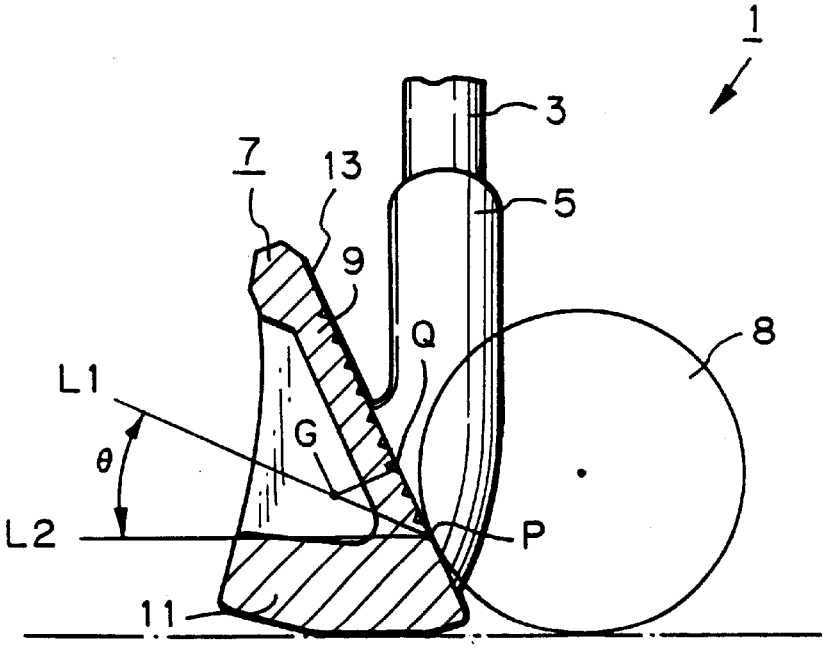
FIG. 15 is an explanatory view for explaining the concept of the angle θ.

Next, another aspect of the present invention will be described with reference to FIG. 15. FIG. 15 shows an iron golf club 1 in a state where the head 7 has been correctly positioned with respect to a ball B upon addressing. At this time, the hosel 5 is perpendicular to the ground as the head 7 is seen from the far side thereof.

In this state, the angle θ of intersection between a horizontal line L2 containing a meeting point P on the face 13 and a line L1 connecting the meeting point P and the center of gravity G of the head 7 is defined. It should be noted that the term "meeting point" as used in this specification means a point where a ball first contacts the face 13 at impact. The meeting point is different from a sweet spot Q (i.e. a point on the face 13 in a line perpendicular to the face 13 from the center of gravity G). The relationship between the meeting point and the sweet spot will be described later.

The intersection angle θ is a novel concept originated with the present inventor. This concept is a combination of the conventional idea that heads having a low center of gravity are good, and a new idea that it is preferable for the center of gravity to lie rearward. The novel concept will be explained below with reference to FIGS. 16 to 18.

Figure 16:
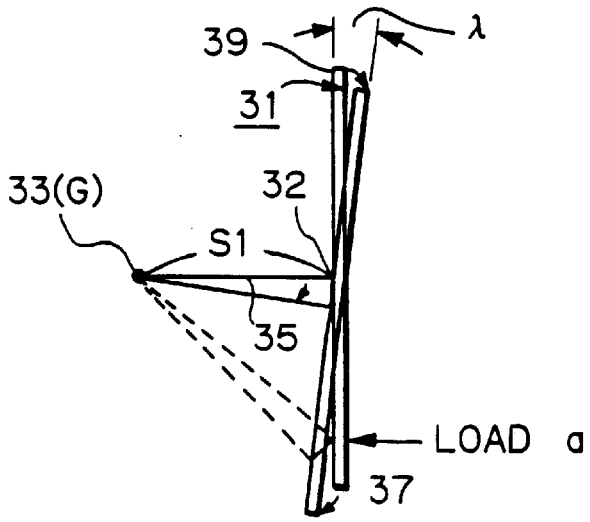
FIG. 16 is a schematic view for explaining that the smaller the angle θ, the smaller the deflection of the clubface.
Figure 17:
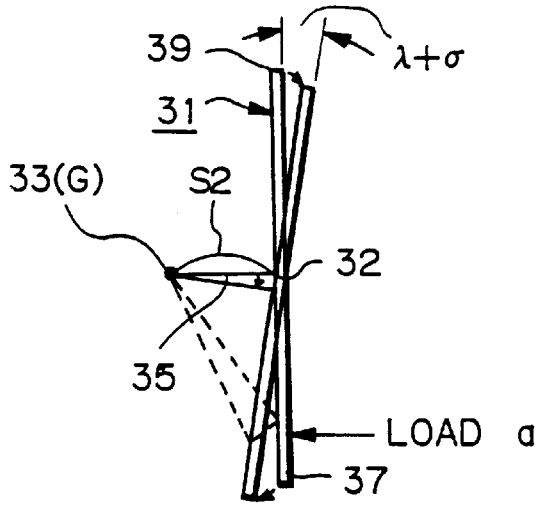
FIG. 17 is a schematic view for explaining that the smaller the angle θ, the smaller the deflection of the clubface.
Figure 18:
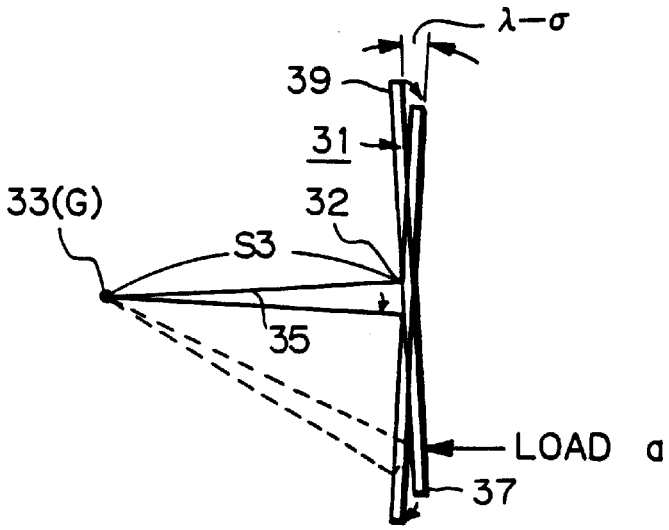
FIG. 18 is a schematic view for explaining that the smaller the angle θ, the smaller the deflection of the clubface.
Figure 19:
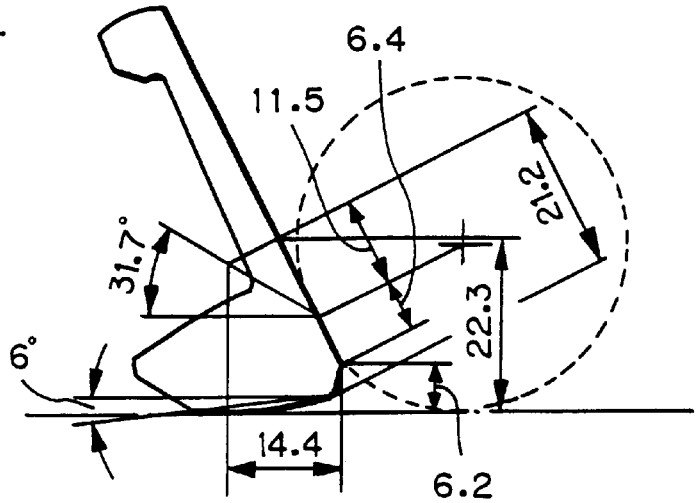
FIG. 19 is a side view of the head of an existing No. 5 iron golf club, showing the angle θ thereof.
Figure 20:
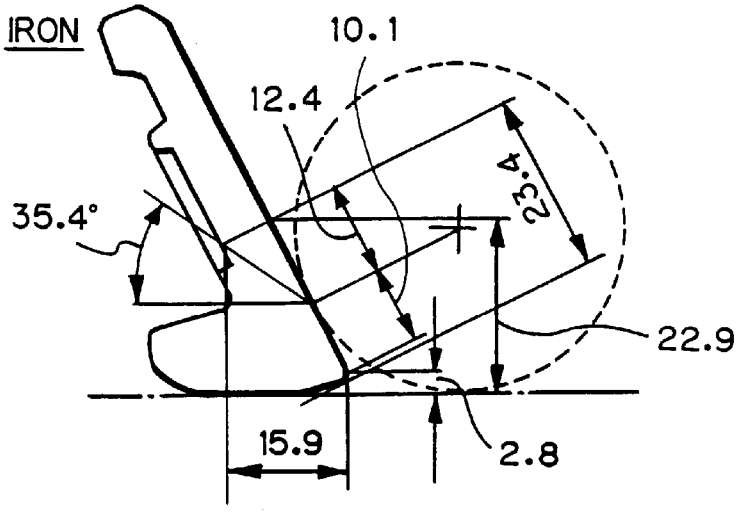
FIG. 20 is a side view of the head of an existing No. 5 iron golf club, showing the angle θ thereof.
Figure 21:
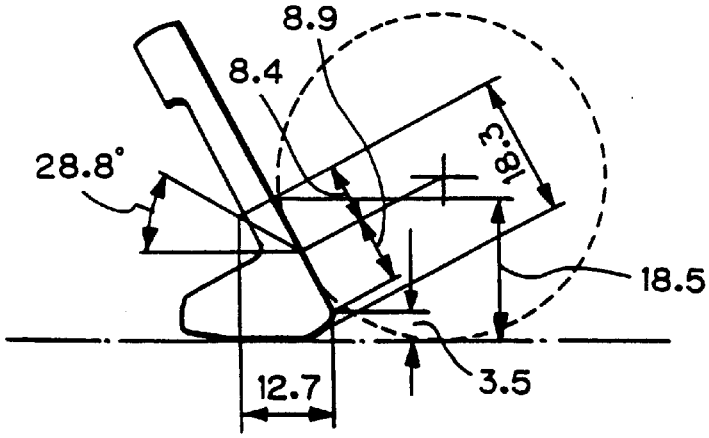
FIG. 21 is a side view of the head of an existing No. 5 iron golf club, showing the angle θ thereof.
Figure 22:
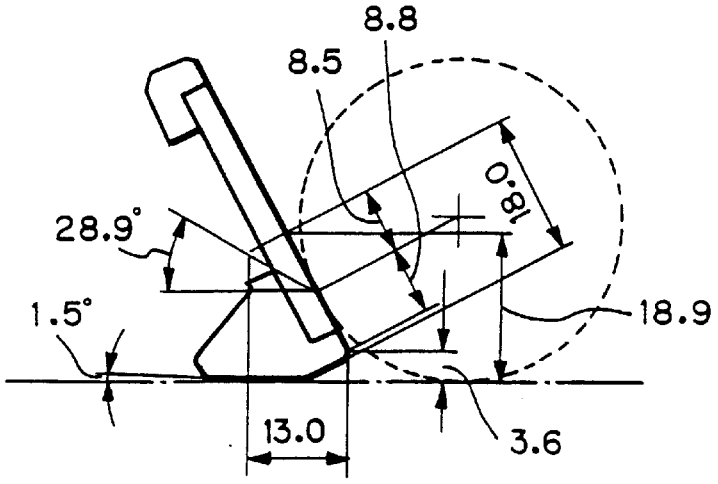
FIG. 22 is a side view of the head of an existing No. 5 iron golf club, showing the angle θ thereof.
Figure 23:
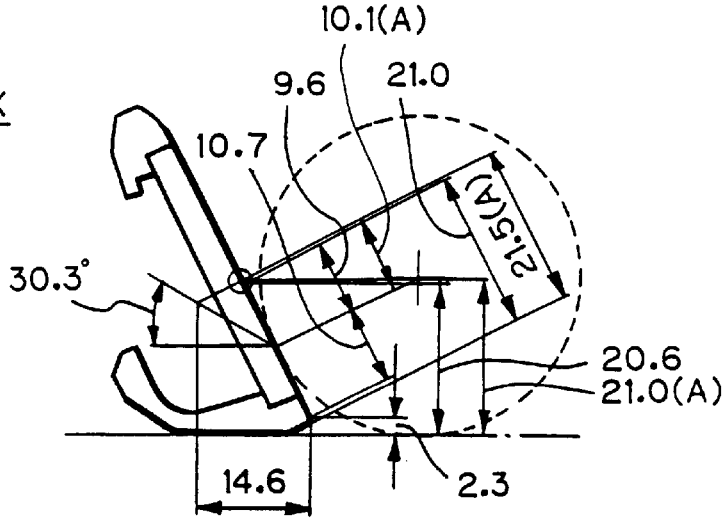
FIG. 23 is a side view of the head of an existing No. 5 iron golf club, showing the angle θ thereof.
Figure 24:
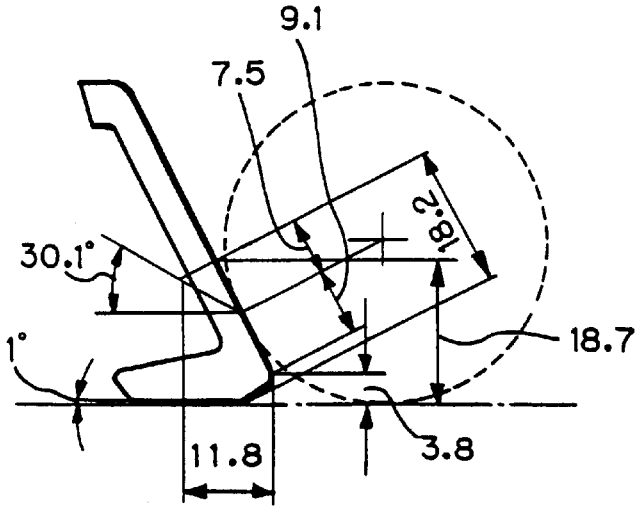
FIG. 24 is a side view of the head of an existing No. 5 iron golf club, showing the angle θ thereof.
Figure 25:
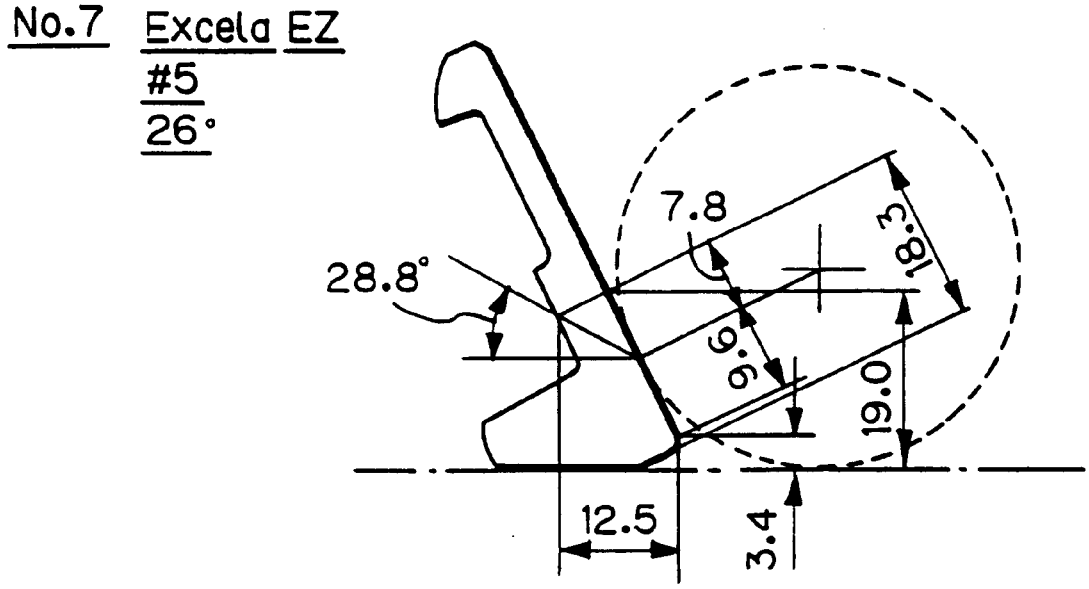
FIG. 25 is a side view of the head of an existing No. 5 iron golf club, showing the angle θ thereof.

FIGS. 16 to 18 show schematically an object 31 having a predetermined length and a rigid support 35 (shown by a straight line) connecting the center 32 of the object 31 and a supporting point 33. In the schematic views, the object 31 and the supporting point 33 can be considered to be respectively corresponding to the face of the head of an iron golf club and the center of gravity thereof.

Referring to FIG. 16, the support 35 has a length S1. In this case, when a load a is momentarily applied to one end 37 of the object 31, the other end 39 of the object 31 rotates through an angle λ.

In contrast, in a case where the support 35 has a length S2 (S2<S1) as shown in FIG. 17, when a load a is momentarily applied to one end 37 of the object 31 under the same conditions as in FIG. 16, the other end 39 of the object 31 rotates through an angle λ+σ (σ>0), which is larger than the angle λ.

In a case where the support 35 has a length S3 (S3>S1) as shown in FIG. 18, when a load a is momentarily applied to one end 37 of the object 31 under the same conditions as in FIG. 16, the other end 39 of the object 31 rotates through an angle λ−δ (δ>0), which is smaller than the angle λ.

Accordingly, when the same load is applied to the same point, the longer the support 35, the smaller the rotation angle of the object 31, that is, the smaller the deflection. Let us apply this to the head of an iron golf club. Assuming that the point to which the load a is applied is the meeting point, the rotation of the clubface, that is, the deflection, when the ball contacts the meeting point decreases as the distance between the clubface and the center of gravity, which corresponds to the supporting point 33, increases, as shown in FIG. 18. Accordingly, it is preferable that the center of gravity of the head should be low, as has heretofore been suggested, and away from the clubface rearwardly, as stated in the above discussion.

In the present invention, the angle θ shown in FIG. 15 is used as an index that shows both how low the center of gravity is and how far it is from the clubface in the rearward direction. It will be understood that in FIG. 16 the angle θ decreases as the center of gravity G moves away from the face 13 rearwardly.

The present inventor measured the angle θ in regard to a variety of existing No. 5 iron golf clubs as shown in FIGS. 19 to 25. The results of the measurement are as follows:

| No. | Manufacturer | Product name | No. of iron | Angle θ |
|---|---|---|---|---|
| 1 | Tommy Armour | Ti100 | No. 5 | 31.7° |
| 2 | Arnald Palmer | PALMAR TITAN IRON | No. 5 | 35.4° |
| 3 | Tommy Armour | 845S | No. 5 | 28.8° |
| 4 | Tommy Armour | GULLIVER | No. 5 | 28.9° |
| 5 | Tommy Armour | GULLIVER 272RX | No. 5 | 30.3° |
| 6 | Tommy Armour | GALILEO 282 | No. 5 | 30.1° |
| 7 | Tommy Armour | Excela EZ | No. 5 | 28.8° |

The measurement revealed that the angles θ in the examined existing No. 5 iron golf clubs are in the range of from 28.8° to 35.4°.

The present inventor made iron golf clubs having various angles θ on a trial basis and tried them out. The results of the test revealed that No. 5 iron golf clubs have a nice feel at impact and deliver good distance when the angle θ is in the range of from 0° to 27.3°, and they are particularly favorable when the angle θ is in the range of from 0° to 24.8°.

Similarly, the angle θ was examined with regard to various irons from a No. 2 iron to a pitching wedge. The results of the examination are as follows:

| | Preferable angle θ | Particularly preferable angle θ |
|---|---|---|
| No. 2 iron | 0~19.2 | 0~17.4 |
| No. 3 iron | 0~23.2 | 0~21.1 |
| No. 4 iron | 0~26.O | 0~23.6 |
| No. 5 iron | 0~27.3 | 0~24.8 |
| No. 6 iron | 0~29.3 | 0~26.6 |
| No. 7 iron | 0~30.3 | 0~27.5 |
| No. 8 iron | 0~31.0 | 0~28.2 |
| No. 9 iron | 0~31.6 | 0~28.7 |
| Pitching wedge | 0~30.8 | 0~28.0 |

Figure 26:
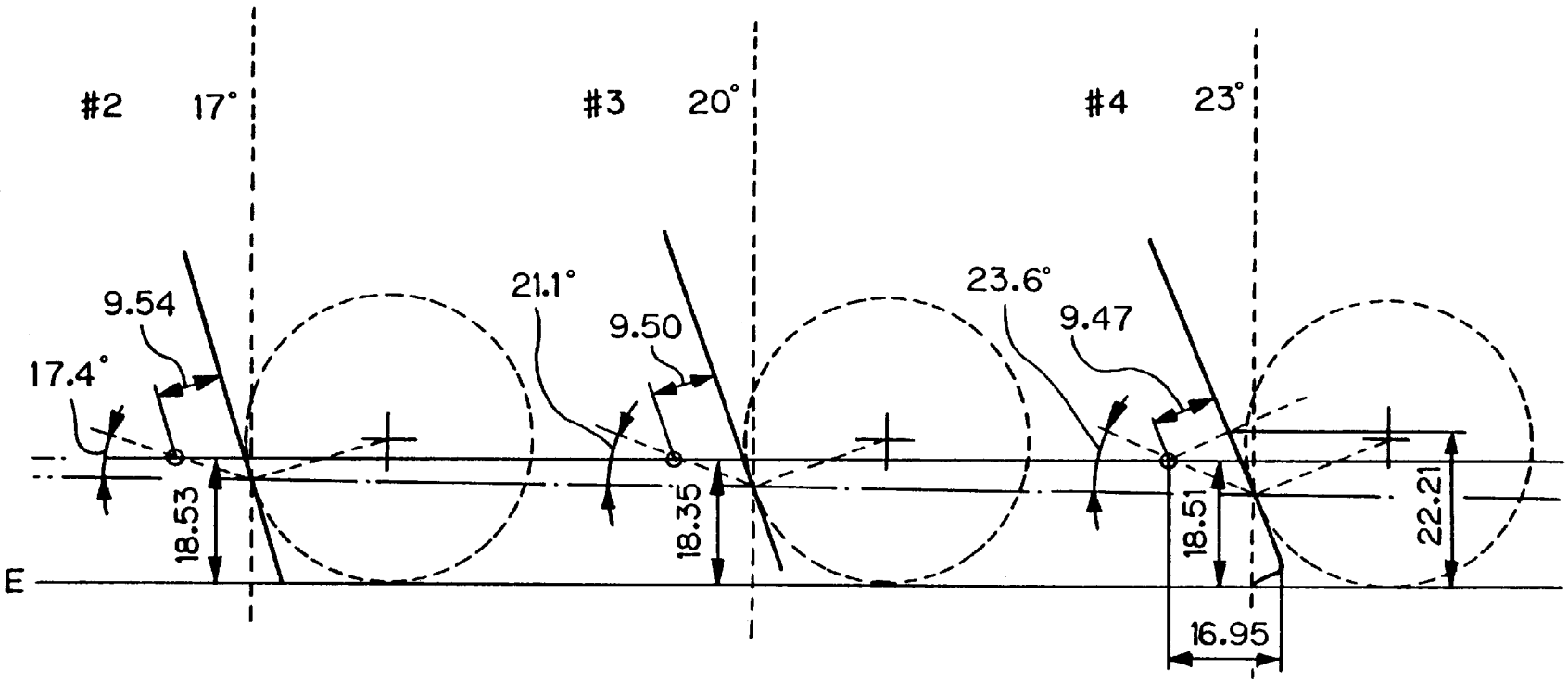
FIG. 26 is an explanatory view showing the relationship between the clubface and the ball upon addressing when the angle θ is set to the upper limit of a particularly preferable angle θ in each of No. 2 to 4 irons.
Figure 27:
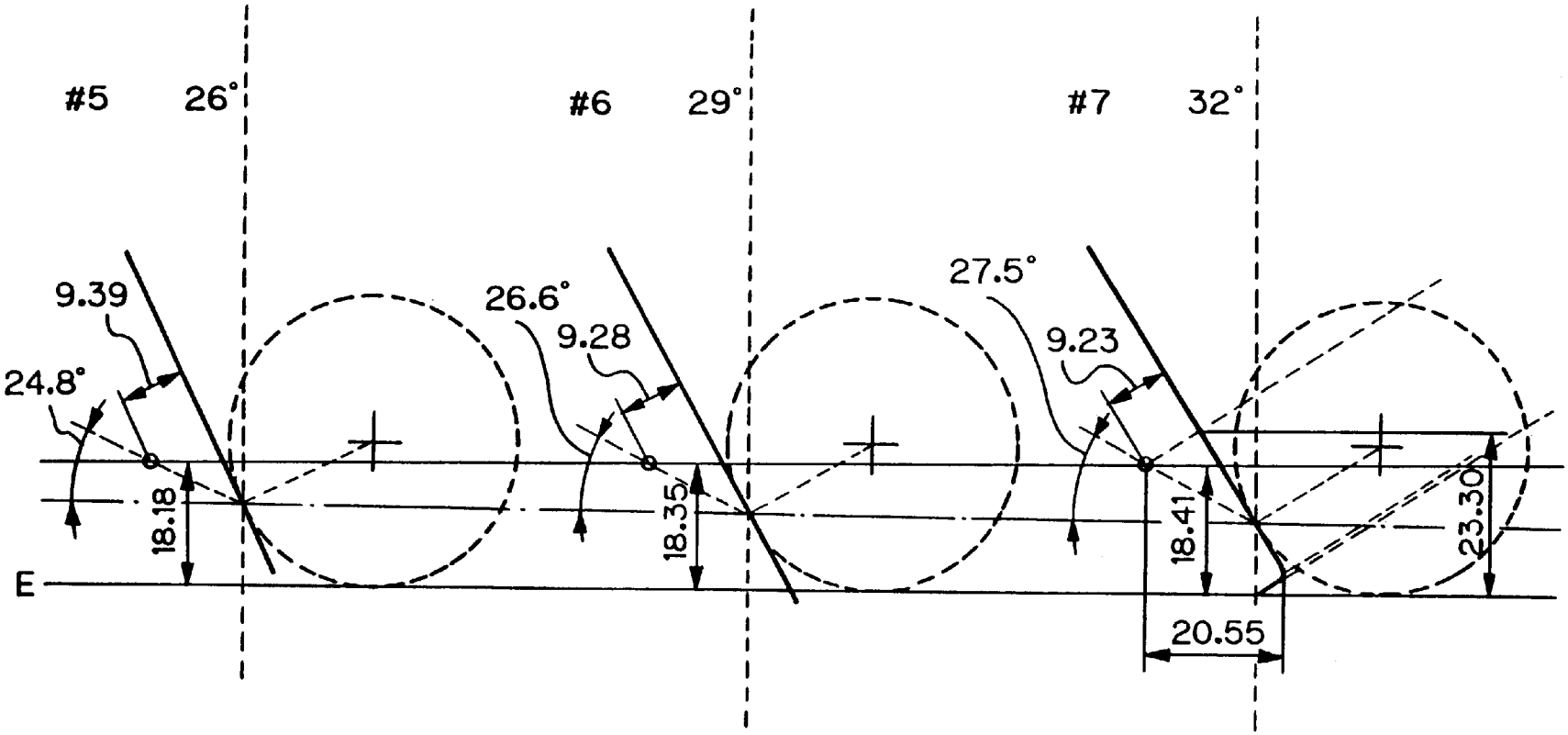
FIG. 27 is an explanatory view showing the relationship between the clubface and the ball upon addressing when the angle θ is set to the upper limit of a particularly preferable angle θ in each of No. 5 to 7 irons.
Figure 28:
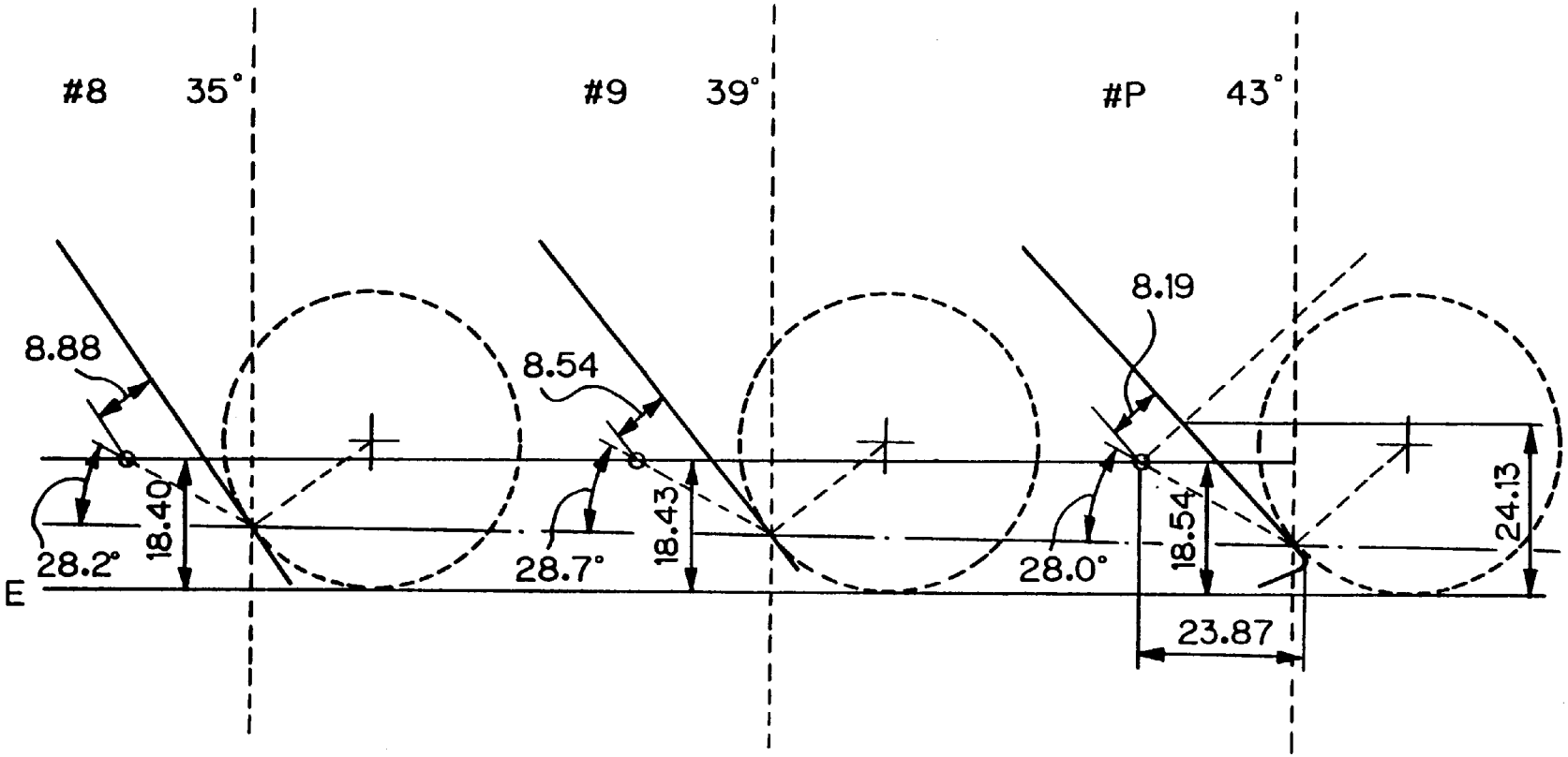
FIG. 28 is an explanatory view showing the relationship between the clubface and the ball upon addressing when the angle θ is set to the upper limit of a particularly preferable angle θ in each of No. 8 and 9 irons and pitching wedge.

FIGS. 26 to 28 show the relationship between the clubface and the ball upon addressing when the angle θ is set to the upper limit of the particularly preferable angle θ in each of the No. 2 to 9 irons and pitching wedge. In FIGS. 26 to 28, the numeral shown after "#" denotes No. of iron golf club. It will be understood from FIGS. 26 to 28 that the centers of gravity G of the iron clubs lie at approximately equal heights from the ground E.

Figure 29:
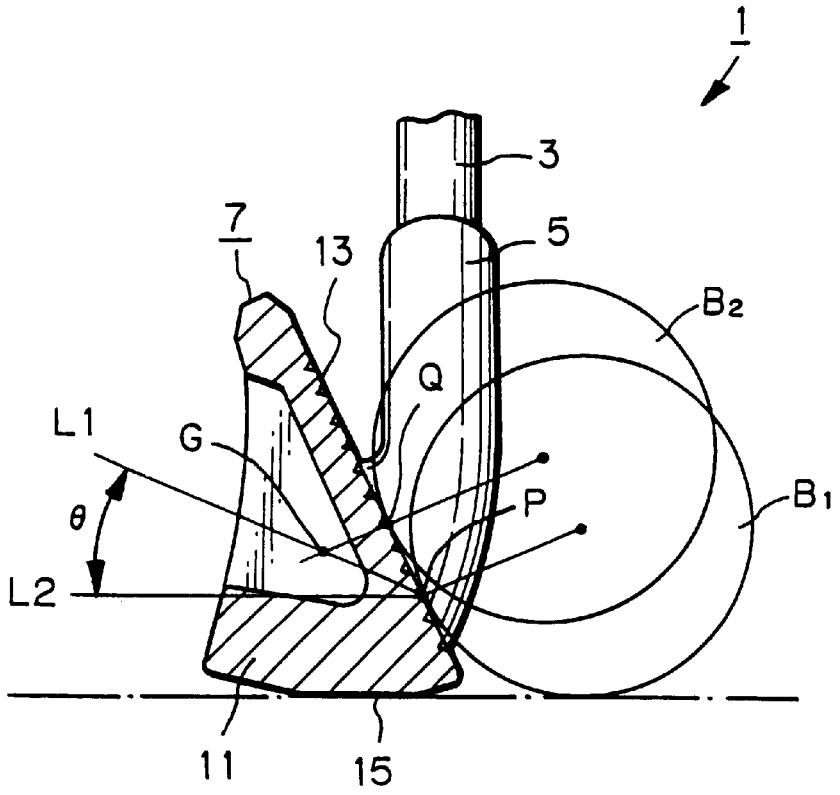
FIG. 29 is a partly-sectioned side view showing the positional relationship between a meeting point and a sweet spot.

Next, another aspect of the present invention will be described. FIG. 29 shows an iron golf club at the moment when a ball is hit with it. In FIG. 29, the ball $B_1$ shows the position of the ball when it first contacts the face 13 at impact.

At this time, the ball $B_1$ contacts the face 13 at a meeting point P. The meeting point P is set below a sweet spot Q (i.e. a point on the face 13 in a line perpendicular to the face 13 from the center of gravity G). The conventional iron golf clubs are designed so that the ball first contacts the sweet spot Q at impact.

However, in a case where the clubface is tilted at a predetermined angle as is the case with iron golf clubs, the clubface meets the ball not at right angles but at a predetermined angle of tilt with respect to the travel direction of the clubface.

At this time, because the force applied to the ball $B_1$ contains an upward component, the ball $B_1$ moves upwardly while rolling on the face 13 for a moment. The rotational force applied to the ball in this way acts as energy causing backspin. Because the ball rolls on the face 13 at impact, the point from which the ball leaves the face 13 is above the sweet spot Q in the conventional golf clubs. Therefore, the ball cannot satisfactorily obtain energy from the face 13.

According to the present invention, the meeting point P lies below the sweet spot Q. Therefore, as shown in FIG. 29, the ball B1 contacting the meeting point P at impact rolls upwardly on the face 13 to a position close to the sweet spot Q to assume the position of the ball $B_2$, from which the ball leaves the face 13. It should be noted that in this specification the point from which the ball leaves the face 13 at impact is defined as a release point. It is preferable in the present invention that the release point should be coincident with the sweet spot Q.

The meeting point P can be set so that the distance from the sweet spot Q to the meeting point P falls within a predetermined range in correspondence to the angle θ for each No. of iron golf club as shown in the table below. The table shows how far the meeting point P is from the sweet spot Q downwardly along the face 13 in units of millimeter.

| | Particularly preferable angle θ | Position of meeting point (mm) |
|---|---|---|
| No. 2 iron | 0~17.4 | 2.92~6.50 |
| No. 3 iron | 0~21.1 | 3.41~8.22 |
| No. 4 iron | 0~23.6 | 4.02~10.01 |
| No. 5 iron | 0~24.8 | 4.58~11.48 |
| No. 6 iron | 0~26.6 | 5.15~13.57 |
| No. 7 iron | 0~27.5 | 5.77~15.65 |
| No. 8 iron | 0~28.2 | 6.22~17.67 |
| No. 9 iron | 0~28.7 | 6.92~20.51 |
| Pitching wed | 0~28.0 | 7.59~23.68 |

Figure 30:
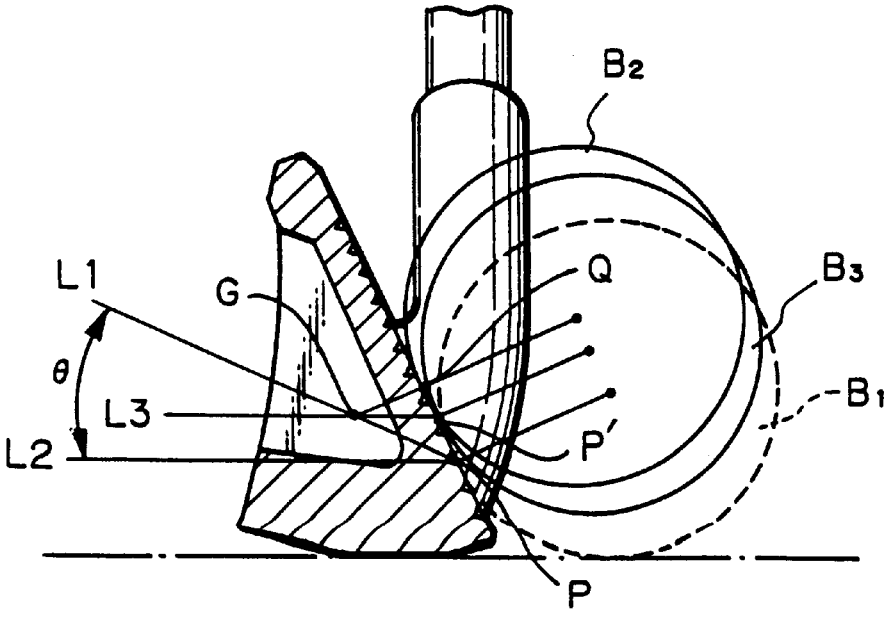
FIG. 30 is a partly-sectioned side view showing a position (between P and P') which the meeting point can assume.

Referring to FIG. 30, P' denotes a meeting point when the angle θ is assumed to be θ=0, and P denotes a meeting point when the angle θ is assumed to be the maximum value of the particularly preferable angle θ in the above table. The meeting point P' is where a line $L_3$ passing through the center of gravity G in parallel to the ground intersects the face 13. The position of the ball when the meeting point is at P' is shown by $B_3$. In FIG. 30, the meeting point can be set somewhere between P and P'.

As has been described above, according to the present invention, the sole forming portion is provided with a hole, a portion of small specific gravity or a hollow portion in the vicinity of the face forming portion to remove a weight from the forward end of the head. Therefore, an extra weight can be added to the rear end of the head to shift the center of gravity toward the rear end thereof.

An iron golf club having the angle θ set to a predetermined value enables a shot with smaller deflection of the clubface than in the case of the conventional iron golf clubs and hence permits the swing force to be transmitted to the ball even more directly, resulting in an increase in the distance the player hits the ball. Designing on the basis of the angle θ makes it possible to obtain even more favorable iron golf clubs.

In evaluation of existing iron golf clubs or iron golf clubs newly produced in the future, each particular iron golf club can be objectively evaluated by examining whether or not the angle θ falls within a predetermined range for each No. of iron.

By setting the meeting point below the sweet spot on the clubface, the release point at impact comes closer to the sweet spot. Therefore, it is possible to send the ball farther distance than with the conventional iron golf clubs.

If the release point is made coincident with the sweet spot, it is possible to provide an iron golf club capable of hitting the ball the farthest distance.

It should be noted that the present invention is not necessarily limited to the above-described embodiments, but may adopt various arrangements without departing from the gist of the present invention.

What is claimed is:

1. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein said sole forming portion is provided with a hole near said face forming portion, and wherein said sole forming portion extends rearwardly so that weight is redistributed to a rearward end of said sole forming portion in at least an amount corresponding to the reduction in weight of the head due to the presence of said hole, thereby substantially shifting a center of gravity of the head toward a rearward end of the head.

2. A head of an iron golf club according to claim 1, wherein said hole is elongated in a widthwise direction of said head.

3. An iron golf club having the head of claim 1.

4. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein said sole forming portion is provided with a hole closer to said face than a center of gravity of said head, and wherein said sole forming portion extends rearwardly so that weight is redistributed to a rearward end of said sole forming portion in at least an amount corresponding to the reduction in weight of the head due to the presence of said hole, thereby substantially shifting a center of gravity of the head toward a rearward end of the head.

5. A head of an iron golf club according to claim 4, wherein said hole is elongated in a widthwise direction of said head.

6. An iron golf club having the head of claim 4.

7. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein a hole is formed in a lower portion of said head near said face, and wherein said sole forming portion extends rearwardly so that weight is redistributed to a rearward end of said sole forming portion in at least an amount corresponding to the reduction in weight of the head due to the presence of said hole, thereby substantially shifting a center of gravity of the head toward a rearward end of the head.

8. A head of an iron golf club according to claim 7, wherein said hole is elongated in a widthwise direction of said head.

9. An iron golf club having the head of claim 7.

10. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein said sole forming portion is provided with a hollow portion near said face forming portion, and wherein said sole forming portion extends rearwardly so that weight is redistributed to a rearward end of said sole forming portion in at least an amount corresponding to the reduction in weight of the head due to the presence of said hollow portion, thereby substantially shifting a center of gravity of the head toward a rearward end of the head.

11. A head of an iron golf club according to claim 10, wherein said hollow portion is elongated in a widthwise direction of said head.

12. An iron golf club having the head of claim 10.

13. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein said sole forming portion is provided with a hollow portion at a position closer to said face than a center of gravity of said head, and wherein said sole forming portion extends rearwardly so that weight is redistributed to a rearward end of said sole forming portion in at least an amount corresponding to the reduction in weight of the head due to the presence of said hollow portion, thereby substantially shifting a center of gravity of the head toward a rearward end of the head.

14. A head of an iron golf club according to claim 13, wherein said hollow portion is elongated in a widthwise direction of said head.

15. An iron golf club having the head of claim 13.

16. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head is defined by a distance from the forward face of the head to a rearward face of the head in a direction perpendicular to the forward face of the head, said thickness of the head at an upper end of the head being less than two-and-a-half times said thickness of the head at a middle portion of the head, wherein a hollow portion is formed in a lower portion of said head near said face, and wherein said sole forming portion extends rearwardly so that weight is redistributed to a rearward end of said sole forming portion in at least an amount corresponding to the reduction in weight of the head due to the presence of said hollow portion, thereby substantially shifting a center of gravity of the head toward a rearward end of the head.

17. A head of an iron golf club according to claim 16, wherein said hollow portion is elongated in a widthwise direction of said head.

18. An iron golf club having the head of claim 16.

19. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein said sole forming portion is provided with a hole near said face forming portion, said hole being contained entirely in said sole forming portion, and wherein said sole forming portion extends rearwardly so that weight is redistributed to a rearward end of said sole forming portion in at least an amount corresponding to the reduction in weight of the head due to the presence of said hole, thereby substantially shifting a center of gravity of the head toward a rearward end of the head.

20. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein said sole forming portion is provided with a hollow portion near said face forming portion, said hollow portion being contained entirely in said sole forming portion, and wherein said sole forming portion extends rearwardly so that weight is redistributed to a rearward end of said sole forming portion in at least an amount corresponding to the reduction in weight of the head due to the presence of said hollow portion, thereby substantially shifting a center of gravity of the head toward a rearward end of the head.

21. A head of an iron golf club, comprising:

a face forming portion having a face formed on a forward surface thereof; and a sole forming portion extending rearwardly from a lower end of said face forming portion, said sole forming portion having a sole formed on a bottom thereof, wherein a thickness of the head from the forward face of the head to a rearward face of the head tapers from a larger thickness at a lower portion of the head to a smaller thickness at an upper portion of the head such that the head has a substantially wedge-shaped configuration, wherein said sole forming portion is provided with a hole near said face forming portion, and wherein said sole forming portion extends rearwardly so that weight is redistributed to a rearward end of said sole forming portion in at least an amount corresponding to the reduction in weight of the head due to the presence of said hole, thereby substantially shifting a center of gravity of the head toward a rearward end of the head.

22. A head of an iron golf club, comprising:

a face forming portion having a face formed on a forward surface thereof; and a sole forming portion extending rearwardly from a lower end of said face forming portion, wherein a thickness of the head from the forward face of the head to a rearward face of the head tapers from a larger thickness at a lower portion of the head to a smaller thickness at an upper portion of the head such that the head has a substantially wedge-shaped configuration, wherein said sole forming portion is provided with a hollow portion near said face forming portion, and wherein said sole forming portion extends rearwardly so that weight is redistributed to a rearward end of said sole forming portion in at least an amount corresponding to the reduction in weight of the head due to the presence of said hollow portion, thereby substantially shifting a center of gravity of the head toward a rearward end of the head.

* * * * *